US007344453B2

(12) United States Patent
Kennedy, III et al.

(10) Patent No.: US 7,344,453 B2
(45) **Date of Patent: *Mar. 18, 2008**

(54) LIQUID-FILLED GOLF BALL WITH PREFERENTIAL INTERNAL STRUCTURES

(75) Inventors: Thomas J. Kennedy, III, Wilbraham, MA (US); Vincent J. Simonds, Brimfield, MA (US); Mark L. Binette, Ludlow, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/764,695

(22) Filed: Jun. 18, 2007

(65) Prior Publication Data

US 2007/0243952 A1 Oct. 18, 2007

Related U.S. Application Data

(63) Continuation of application No. 11/530,317, filed on Sep. 8, 2006, now Pat. No. 7,232,382.

(60) Provisional application No. 60/715,733, filed on Sep. 9, 2005.

(51) Int. Cl.
*A63B 37/08* (2006.01)

(52) U.S. Cl. ..... 473/354

(58) Field of Classification Search ..... 473/354
See application file for complete search history.

(56) References Cited

U.S. PATENT DOCUMENTS

| | | | | |
|---|---|---|---|---|
| 4,431,193 | A * | 2/1984 | Nesbitt | 473/374 |
| 6,193,618 | B1 * | 2/2001 | Sullivan et al. | 473/373 |
| 6,238,304 | B1 * | 5/2001 | Scolamiero et al. | 473/354 |
| 6,409,614 | B1 * | 6/2002 | Binette et al. | 473/371 |
| 7,232,382 | B2 * | 6/2007 | Kennedy et al. | 473/354 |
| 2003/0236136 | A1 * | 12/2003 | Dijkgraaf et al. | 473/351 |

* cited by examiner

*Primary Examiner*—Raeann Trimiew
(74) *Attorney, Agent, or Firm*—Michael A. Catania; Elaine H. Lo

(57) ABSTRACT

A golf ball having a spherical shell with a plurality of internal structures is disclosed herein. A fluid material is disposed within the spherical shell. The plurality of internal structures influence the spin decay of the golf ball.

7 Claims, 5 Drawing Sheets

FIG. 4
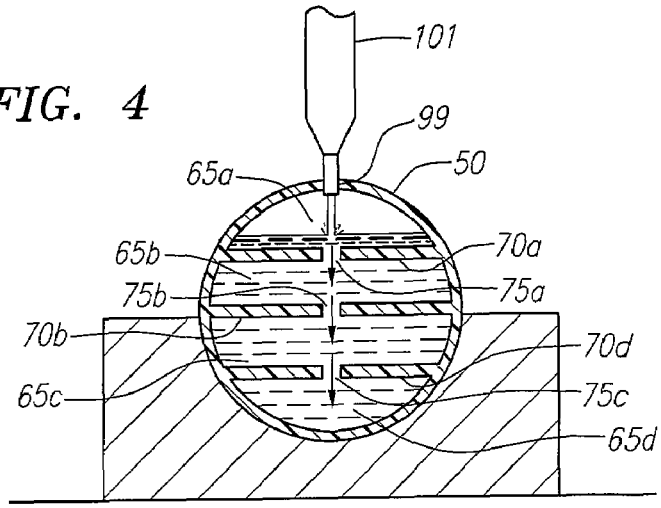
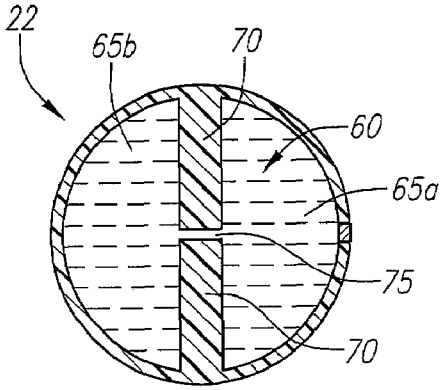
FIG. 5a
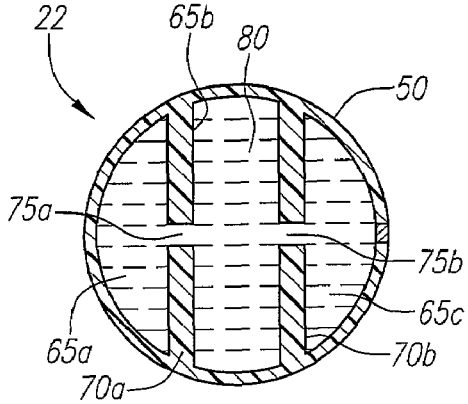
FIG. 5b
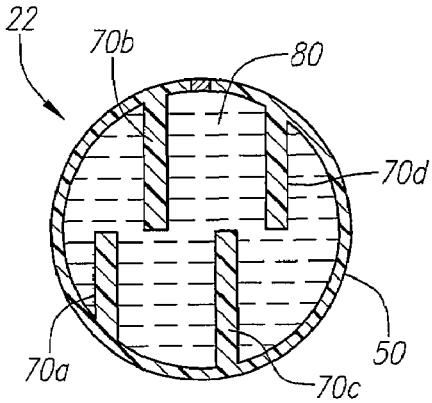
FIG. 5c
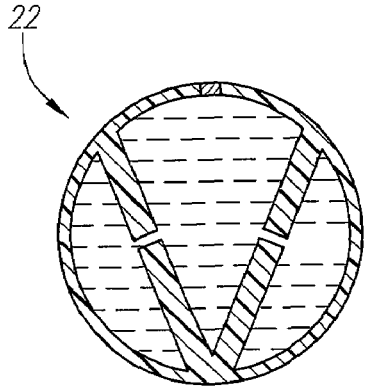
FIG. 5d

LIQUID-FILLED GOLF BALL WITH PREFERENTIAL INTERNAL STRUCTURES

CROSS REFERENCES TO RELATED APPLICATIONS

The Present Application is a continuation of U.S. patent application Ser. No. 11/530,317, filed on Sep. 8, 2006 now U.S. Pat. No. 7,232,382, which claims priority to U.S. Provisional Patent Application No. 60/715,733, which was filed on Sep. 9, 2005.

STATEMENT REGARDING FEDERALLY SPONSORED RESEARCH OR DEVELOPMENT

Not Applicable

BACKGROUND OF THE INVENTION

1. Field of the Invention

The present invention relates to a golf ball. More specifically, the present invention relates to a golf ball with a liquid-filled core that includes internal structures.

2. Description of the Related Art

Fluid filled cores for golf balls have been practiced in the prior art.

BRIEF SUMMARY OF THE INVENTION

A golf ball with a core having internal structures and a fluid for affecting the spin of the golf ball is disclosed herein. A fluid is placed within an interior chamber of a shell of the core.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 4 is an isolated cross-sectional view of a core receiving a liquid from a dispenser.

FIG. 5*a* is a cross-sectional view of a preferred embodiment of a core.

FIG. 5*b* is a cross-sectional view of an alternative embodiment of a core.

FIG. 5*c* is a cross-sectional view of an alternative embodiment of a core.

FIG. 5*d* is a cross-sectional view of an alternative embodiment of a core.

DETAILED DESCRIPTION OF THE INVENTION

Figure 1:
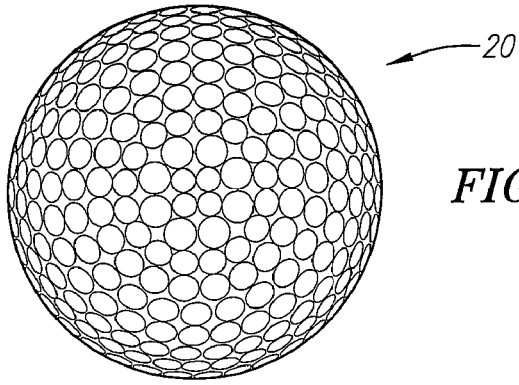
FIG. 1 is an equatorial view of a golf ball.
Figure 2:
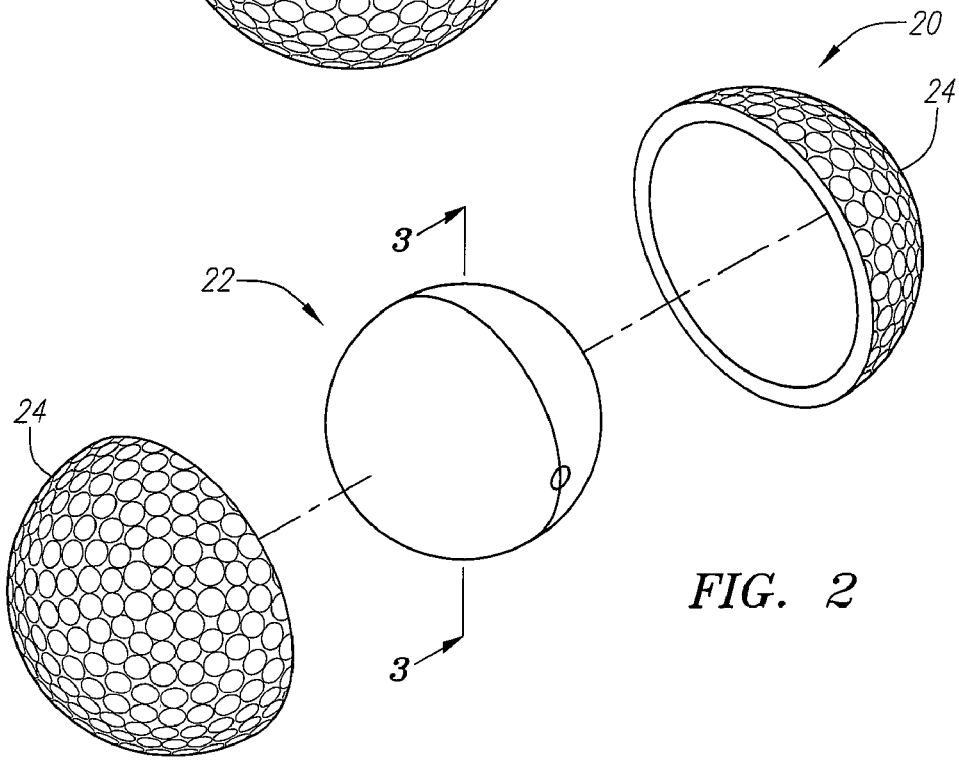
FIG. 2 is an exploded view of a golf ball.

As shown in FIGS. 1-11, a golf ball is generally designated 20. The golf ball has a core 22 and a cover 24. An Alternative embodiment of the golf ball 20 has a mantle layer 28 disposed between the core 22 and the cover 24. The core 22 has a spherical shell 50 with a shell wall 52. The spherical shell defines an interior chamber 60. The core 22 has a plurality of internal structures 70 partitioning the interior chamber 60 into a plurality of sub-chambers 65. A fluid 80 is disposed within the interior chamber 60. Preferably, the fluid occupies 50% to 100% of the available space of the interior chamber 60. The available space is the space not occupied by an internal structure 70. The fluid 80 is preferably selected from the group consisting of corn syrup, alcohol, water, propylene, glycol and mineral oil. Other fluids that may be used in the present invention are disclosed in U.S. Pat. Nos. 6,193,618, 6,244,977, and 5,480,155, all of which are hereby incorporated by reference in their entirety.

Figure 6:
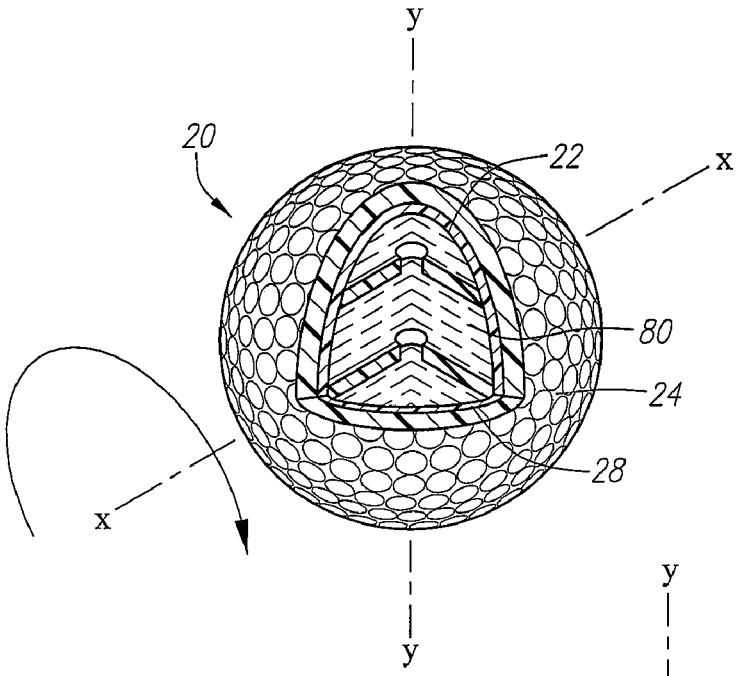
FIG. 6 is a partial cut-away view of a golf ball.
Figure 7:
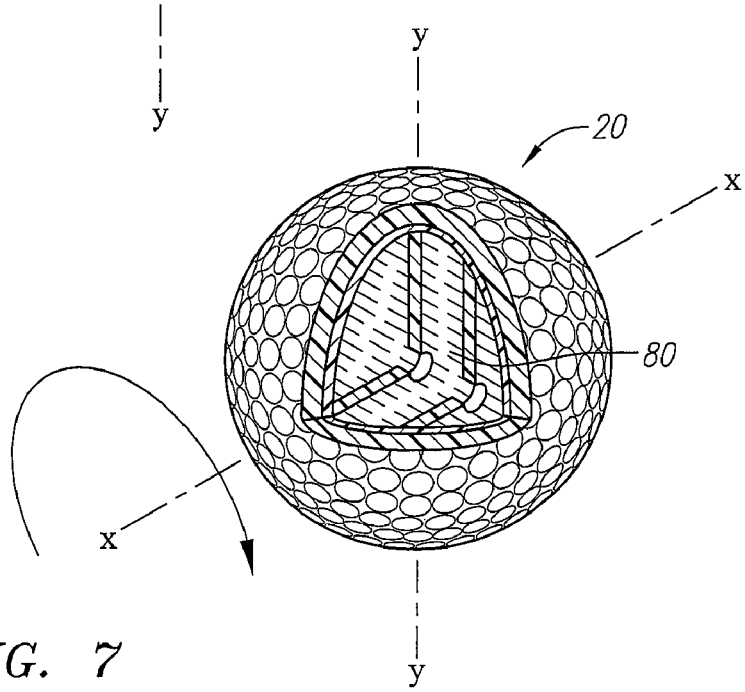
FIG. 7 is a partial cut-away view of a golf ball.
Figure 8:
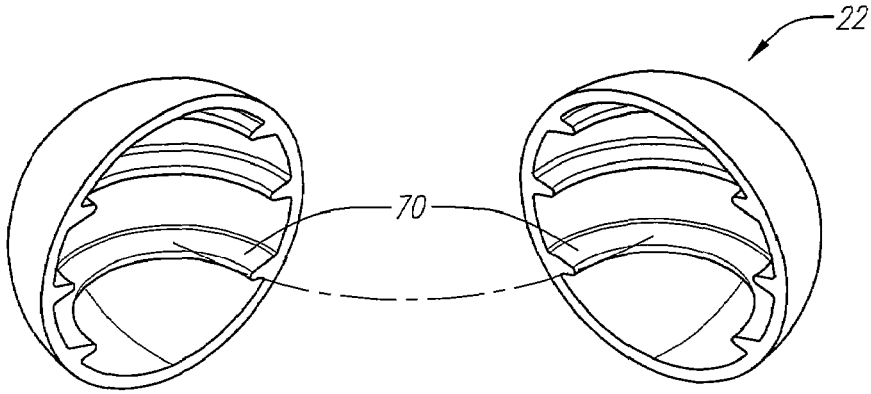
FIG. 8 is a cut-away view of a core.
Figure 9:
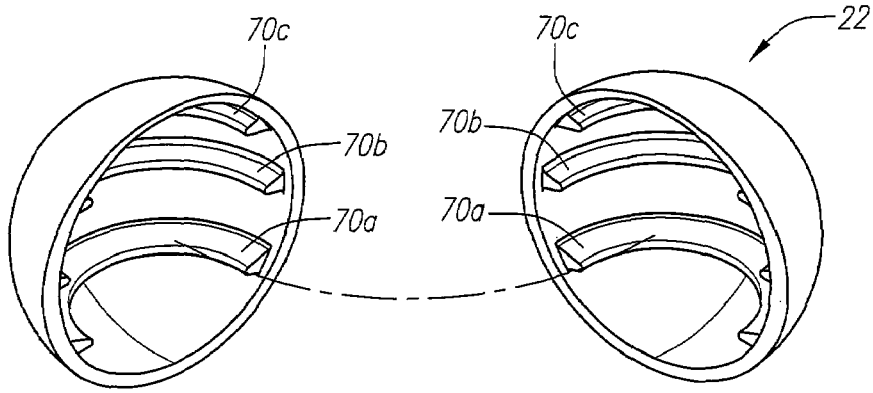
FIG. 9 is a cut-away view of a core.
Figure 10:
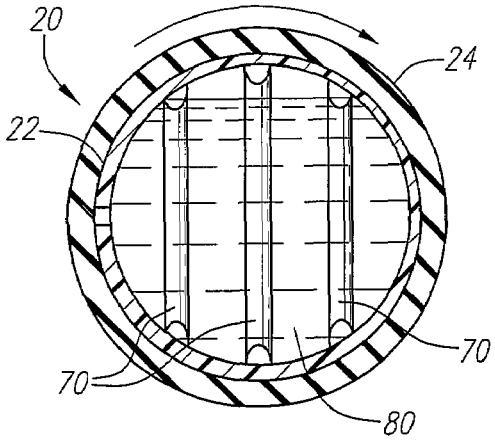
FIG. 10 is a cross-sectional view of a core.
Figure 11:
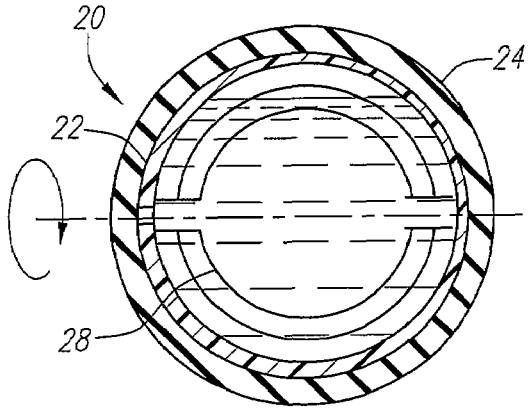
FIG. 11 is a cross-sectional view of a core.

In a preferred embodiment, each of the plurality of sub-chambers 65 is in flow communication with at least one other sub chamber 65 through an aperture 75 in each of the internal structures 70 or through other access means such as an access corridor between sub chambers 65. The fluid 80 is allowed to flow through each of the plurality of sub-chambers. The internal structures 70 affect the flow of the fluid material 80 when the golf ball 20 is struck with a club, which results in the spin decay of the golf ball 20 being affected by the flow of the fluid 80 as well as its coupling with the interior wall of the sphere. As shown in FIGS. 6 and 7, depending on the axis of spin, the golf ball 20 will spin with the fluid 80 or against it.

Figure 5E:
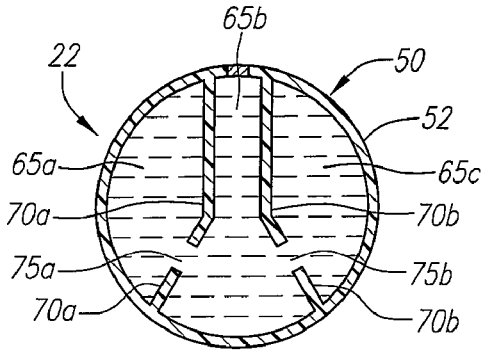
FIG. 5*e* is a cross-sectional view of an alternative embodiment of a core.
Figure 5F:
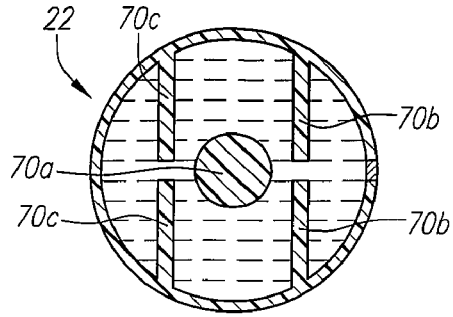
FIG. 5*f* is a cross-sectional view of an alternative embodiment of a core.
Figure 5G:
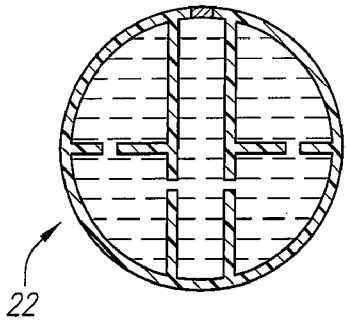
FIG. 5*g* is a cross-sectional view of an alternative embodiment of a core.
Figure 5H:
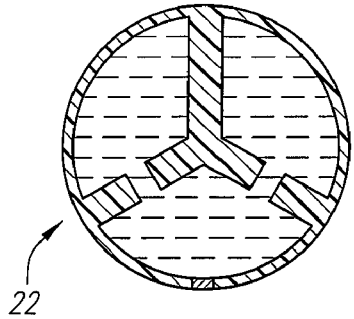
FIG. 5*h* is a cross-sectional view of an alternative embodiment of a core.
Figure 5I:
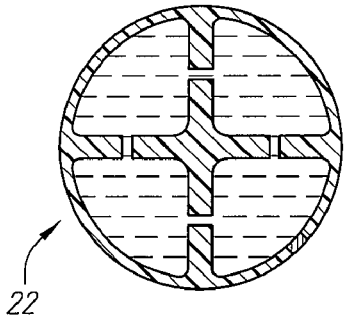
FIG. 5*i* is a cross-sectional view of an alternative embodiment of a core.
Figure 5J:
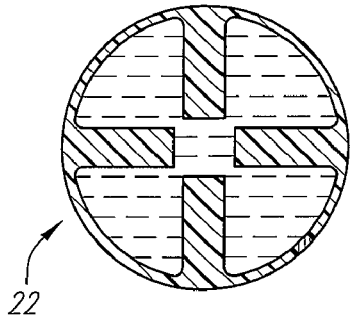
FIG. 5*j* is a cross-sectional view of an alternative embodiment of a core.
Figure 5K:
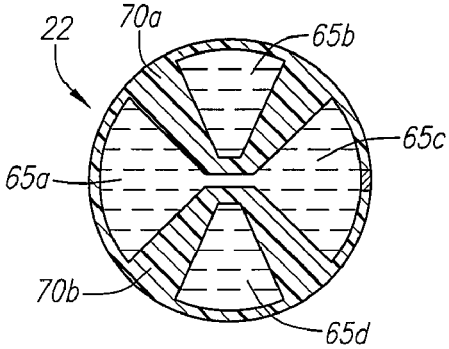
FIG. 5*k* is a cross-sectional view of an alternative embodiment of a core.
Figure 5L:
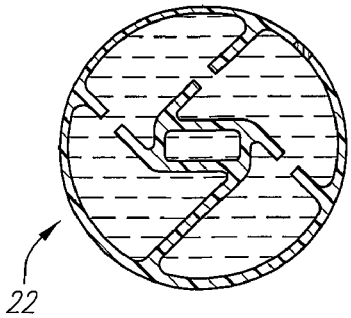
FIG. 5*l* is a cross-sectional view of an alternative embodiment of a core.
Figure 5M:
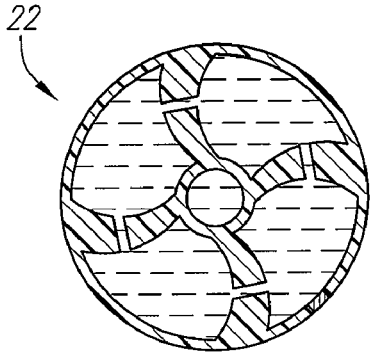
FIG. 5*m* is a cross-sectional view of an alternative embodiment of a core.

The number of internal structures 70 preferably varies from one to twenty, and other ranges in between one and twenty. The thickness, T, (as shown in FIG. 5*a*) of each of the internal structures 70 preferably ranges from 0.010 inch to 0.250 inch. Preferably, each internal structure 70 is composed of the same material as the spherical shell 50. Preferred materials for both the spherical shell and internal structures include polymers and metals. A preferred metal is a titanium alloy. Other preferred metals are listed in the above mentioned patent applications. Preferred polymers include vinyl resins, polyolefins, polyurethanes, polyamides, acrylic resins, thermoplastic rubbers, polyphenylene oxides, thermoplastic polyesters, polycarbonates, and blends thereof. Still other polymers are listed in the above-mentioned patent applications.

The cross-sectional shape of each of the internal structures 70 is preferably square or circular. However, as shown in FIGS. 1-11, the cross-sectional shape of each of the internal structures 70 may vary.

Figure 3:
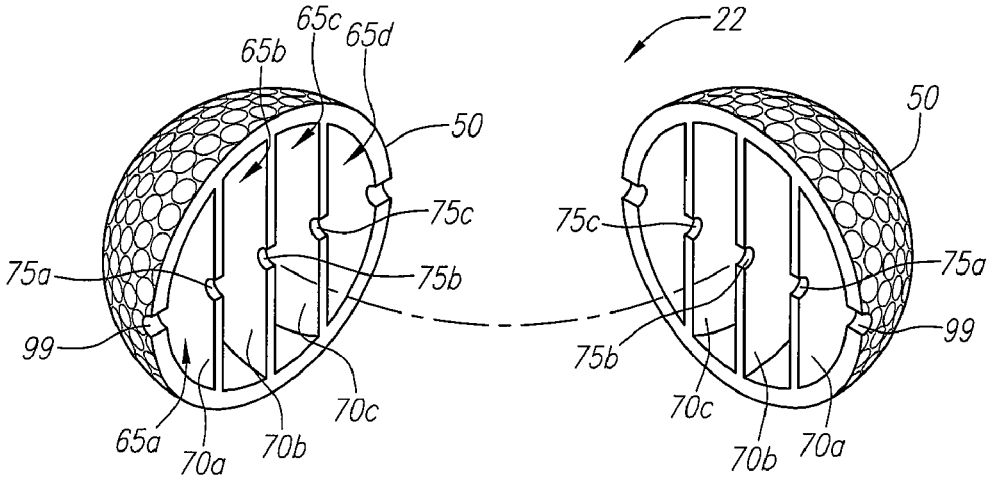
FIG. 3 is a cut-away view of a core of a golf ball.

A preferred embodiment of a core 22 is shown in FIG. 3. Three internal structures 70*a*, 70*b* and 70*c* form four sub-chambers 65*a*, 65*b*, 65*c* and 65*d*. Each internal structure 70*a-c* has an aperture 75*a-c* for flow communication between the sub-chambers 65*a-d*. Aperture 99 is for introducing the fluid 80 into the core 22.

As shown in FIG. 4, a fluid dispenser 101 is utilized to introduce the fluid 80 through aperture 99 and into the interior chamber 60. Once the fluid 80 is introduced into the interior chamber 60, the aperture 99 is preferably sealed with a material similar to the material of the shell wall 52. Then a cover 24 is formed over the core 22, or alternatively a mantle layer 28 is formed over the core 22 and then a cover 24.

Figure 5N:
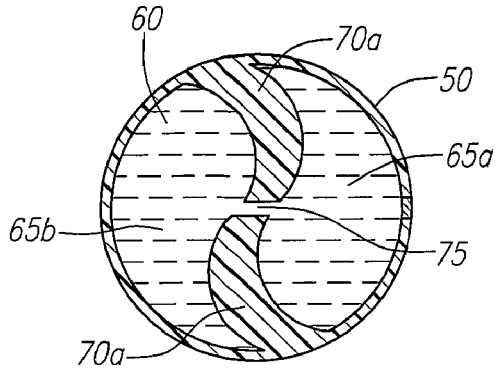
FIG. 5*n* is a cross-sectional view of an alternative embodiment of a core.

FIGS. 5*a*-5*n* illustrates various cores 22 with various internal structures 70.

In a preferred embodiment, the cover 24 is composed of a RIM polyurethane material such as disclosed in U.S. Patent Number, which pertinent parts are hereby incorporated by reference. In an alternative embodiment, the golf ball 20 is constructed with a cover 24 composed of a polyurethane material as set forth in U.S. Pat. No. 6,117,024, for a Golf Ball With A Polyurethane Cover, which pertinent parts are hereby incorporated by reference. The golf ball 20 preferably has a coefficient of restitution at 125 feet per second greater than 0.750, and an USGA initial velocity less than 255.0 feet per second. The golf ball 20 more preferably has a COR of approximately 0.760 at 125 feet per second, and an initial velocity between 250 feet per second to 255 feet per second under USGA initial velocity conditions. A more thorough description of a high COR golf ball is disclosed in U.S. Pat. No. 6,443,858, which pertinent parts are hereby incorporated by reference.

The cover 24 of the golf ball 20 may be any suitable material. A preferred cover for a three-piece golf ball is composed of a thermoset polyurethane material. Alternatively, the cover 24 is composed of a thermoplastic polyurethane, ionomer blend, ionomer rubber blend, ionomer and thermoplastic polyurethane blend, or like materials. Those skilled in the pertinent art will recognize that other cover materials may be utilized without departing from the scope and spirit of the present invention. The golf ball 20 may have a finish of one or two basecoats and/or one or two top coats.

In an alternative embodiment of a golf ball 20, the mantle layer 28 or cover layer 24 is comprised of a high acid (i.e. greater than 16 weight percent acid) ionomer resin or high acid ionomer blend. More preferably, the mantle layer 28 is comprised of a blend of two or more high acid (i.e. greater than 16 weight percent acid) ionomer resins neutralized to various extents by different metal cations.

In an alternative embodiment of a golf ball 20, the mantle layer 28 or cover layer 24 is comprised of a low acid (i.e. 16 weight percent acid or less) ionomer resin or low acid ionomer blend. Preferably, the mantle layer 28 is comprised of a blend of two or more low acid (i.e. 16 weight percent acid or less) ionomer resins neutralized to various extents by different metal cations. The mantle layer 28 compositions of the embodiments described herein may include the high acid ionomers such as those developed by E. I. DuPont de Nemours & Company under the SURLYN brand, and by Exxon Corporation under the ESCOR or IOTEK brands, or blends thereof. Examples of compositions which may be used as the mantle layer 28 herein are set forth in detail in U.S. Pat. No. 5,688,869, which is incorporated herein by reference. Of course, the mantle layer 28 high acid ionomer compositions are not limited in any way to those compositions set forth in said patent. Those compositions are incorporated herein by way of examples only.

The high acid ionomers which may be suitable for use in formulating the mantle layer 28 compositions are ionic copolymers which are the metal (such as sodium, zinc, magnesium, etc.) salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (for example, iso- or n-butylacrylate, etc.) can also be included to produce a softer terpolymer. The carboxylic acid groups of the copolymer are partially neutralized (for example, approximately 10-100%, preferably 30-70%) by the metal ions. Each of the high acid ionomer resins which may be included in the inner layer cover compositions of the invention contains greater than 16% by weight of a carboxylic acid, preferably from about 17% to about 25% by weight of a carboxylic acid, more preferably from about 18.5% to about 21.5% by weight of a carboxylic acid. Examples of the high acid methacrylic acid based ionomers found suitable for use in accordance with this invention include, but are not limited to, SURLYN 8220 and 8240 (both formerly known as forms of SURLYN AD-8422), SURLYN 9220 (zinc cation), SURLYN SEP-503-1 (zinc cation), and SURLYN SEP-503-2 (magnesium cation). According to DuPont, all of these ionomers contain from about 18.5 to about 21.5% by weight methacrylic acid. Examples of the high acid acrylic acid based ionomers suitable for use in the present invention also include, but are not limited to, the high acid ethylene acrylic acid ionomers produced by Exxon such as Ex 1001, 1002, 959, 960, 989, 990, 1003, 1004, 993, and 994. In this regard, ESCOR or IOTEK 959 is a sodium ion neutralized ethylene-acrylic neutralized ethylene-acrylic acid copolymer. According to Exxon, IOTEKS 959 and 960 contain from about 19.0 to about 21.0% by weight acrylic acid with approximately 30 to about 70 percent of the acid groups neutralized with sodium and zinc ions, respectively.

Furthermore, as a result of the previous development by the assignee of this application of a number of high acid ionomers neutralized to various extents by several different types of metal cations, such as by manganese, lithium, potassium, calcium and nickel cations, several high acid ionomers and/or high acid ionomer blends besides sodium, zinc and magnesium high acid ionomers or ionomer blends are also available for golf ball cover production. It has been found that these additional cation neutralized high acid ionomer blends produce mantle layer 28 compositions exhibiting enhanced hardness and resilience due to synergies which occur during processing. Consequently, these metal cation neutralized high acid ionomer resins can be blended to produce substantially higher C.O.R.'s than those produced by the low acid ionomer mantle layer 28 compositions presently commercially available.

More particularly, several metal cation neutralized high acid ionomer resins have been produced by the assignee of this invention by neutralizing, to various extents, high acid copolymers of an alpha-olefin and an alpha, beta-unsaturated carboxylic acid with a wide variety of different metal cation salts. This discovery is the subject matter of U.S. Pat. No. 5,688,869, which is hereby incorporated by reference. It has been found that numerous metal cation neutralized high acid ionomer resins can be obtained by reacting a high acid copolymer (i.e. a copolymer containing greater than 16% by weight acid, preferably from about 17 to about 25 weight percent acid, and more preferably about 20 weight percent acid), with a metal cation salt capable of ionizing or neutralizing the copolymer to the extent desired (for example, from about 10% to 90%).

The base copolymer is made up of greater than 16% by weight of an alpha, beta-unsaturated carboxylic acid and an alpha-olefin. Optionally, a softening comonomer can be included in the copolymer. Generally, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotonic acid, maleic acid, fumaric acid, and itaconic acid, with acrylic acid being preferred.

The softening comonomer that can be optionally included in the mantle layer 28 of the golf ball of the invention may be selected from the group consisting of vinyl esters of aliphatic carboxylic acids wherein the acids have 2 to 10 carbon atoms, vinyl ethers wherein the alkyl groups contain 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high acid ionomers included in the present invention include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, etc. The base copolymer broadly contains greater than 16% by weight unsaturated carboxylic acid, from about 39 to about 83% by weight ethylene and from 0 to about 40% by weight of a softening comonomer. Preferably, the copolymer contains about 20% by weight unsaturated carboxylic acid and about 80% by weight ethylene. Most preferably, the copolymer contains about 20% acrylic acid with the remainder being ethylene.

The mantle layer 28 compositions may include the low acid ionomers such as those developed and sold by E. I. DuPont de Nemours & Company under the SURLYN and by Exxon Corporation under the brands ESCOR and IOTEK, ionomers made in-situ, or blends thereof.

Another embodiment of the mantle layer 28 comprises a non-ionomeric thermoplastic material or thermoset material. Suitable non-ionomeric materials include, but are not limited to, metallocene catalyzed polyolefins or polyamides, polyamide/ionomer blends, polyphenylene ether/ionomer blends, etc., which preferably have a Shore D hardness of at least 60 (or a Shore C hardness of at least about 90) and a flex modulus of greater than about 30,000 psi, preferably greater than about 50,000 psi, or other hardness and flex modulus values which are comparable to the properties of the ionomers described above. Other suitable materials include but are not limited to, thermoplastic or thermosettin g polyurethanes, thermoplastic block polyesters, for example, a polyester elastomer such as that marketed by DuPont under the brand HYTREL, or thermoplastic block polyamides, for example, a polyether amide such as that marketed by Elf Atochem S. A. under the brand PEBEX, a blend of two or more non-ionomeric thermoplastic elastomers, or a blend of one or more ionomers and one or more non-ionomeric thermoplastic elastomers. These materials can be blended with the ionomers described above in order to reduce cost relative to the use of higher quantities of ionomer.

Additional materials suitable for use in the mantle layer 28 or cover layer 24 of the present invention include polyurethanes. These are described in more detail below.

In one embodiment, the cover layer 24 is comprised of a relatively soft, low flex modulus (about 500 psi to about 50,000 psi, preferably about 1,000 psi to about 25,000 psi, and more preferably about 5,000 psi to about 20,000 psi) material or blend of materials. Preferably, the cover layer 24 comprises a polyurethane, a polyurea, a blend of two or more polyurethanes/polyureas, or a blend of one or more ionomers or one or more non-ionomeric thermoplastic materials with a polyurethane/polyurea, preferably a thermoplastic polyurethane or reaction injection molded polyurethane/polyurea (described in more detail below).

The cover layer 24 preferably has a thickness in the range of 0.005 inch to about 0.15 inch, more preferably about 0.010 inch to about 0.050 inch, and most preferably 0.015 inch to 0.025 inch. In one embodiment, the cover layer 24 has a Shore D hardness of 60 or less (or less than 90 Shore C), and more preferably 55 or less (or about 80 Shore C or less). In another preferred embodiment, the cover layer 24 is comparatively harder than the mantle layer 28.

In one preferred embodiment, the cover layer 24 comprises a polyurethane, a polyurea or a blend of polyurethanes/polyureas. Polyurethanes are polymers which are used to form a broad range of products. They are generally formed by mixing two primary ingredients during processing. For the most commonly used polyurethanes, the two primary ingredients are a polyisocyanate (for example, 4,4'-diphenylmethane diisocyanate monomer ("MDI") and toluene diisocyanate ("TDI") and their derivatives) and a polyol (for example, a polyester polyol or a polyether polyol).

A wide range of combinations of polyisocyanates and polyols, as well as other ingredients, are available. Furthermore, the end-use properties of polyurethanes can be controlled by the type of polyurethane utilized, such as whether the material is thermoset (cross linked molecular structure not flowable with heat) or thermoplastic (linear molecular structure flowable with heat).

Cross linking occurs between the isocyanate groups (—NCO) and the polyol's hydroxyl end-groups (—OH). Cross linking will also occur between the $NH_2$ group of the amines and the NCO groups of the isocyanates, forming a polyurea. Additionally, the end-use characteristics of polyurethanes can also be controlled by different types of reactive chemicals and processing parameters. For example, catalysts are utilized to control polymerization rates. Depending upon the processing method, reaction rates can be very quick (as in the case for some reaction injection molding systems ("RIM")) or may be on the order of several hours or longer (as in several coating systems such as a cast system). Consequently, a great variety of polyurethanes are suitable for different end-uses.

Polyurethanes are typically classified as thermosetting or thermoplastic. A polyurethane becomes irreversibly "set" when a polyurethane prepolymer is cross linked with a polyfunctional curing agent, such as a polyamine or a polyol. The prepolymer typically is made from polyether or polyester. A prepolymer is typically an isocyanate terminated polymer that is produced by reacting an isocyanate with a moiety that has active hydrogen groups, such as a polyester and/or polyether polyol. The reactive moiety is a hydroxyl group. Diisocyanate polyethers are preferred because of their water resistance.

The physical properties of thermoset polyurethanes are controlled substantially by the degree of cross linking and by the hard and soft segment content. Tightly cross linked polyurethanes are fairly rigid and strong. A lower amount of cross linking results in materials that are flexible and resilient. Thermoplastic polyurethanes have some cross linking, but primarily by physical means, such as hydrogen bonding. The crosslinking bonds can be reversibly broken by increasing temperature, such as during molding or extrusion. In this regard, thermoplastic polyurethanes can be injection molded, and extruded as sheet and blow film. They can be used up to about 400 degrees Fahrenheit, and are available in a wide range of hardnesses.

Polyurethane materials suitable for the present invention may be formed by the reaction of a polyisocyanate, a polyol, and optionally one or more chain extenders. The polyol component includes any suitable polyether- or polyester polyol. Additionally, in an alternative embodiment, the polyol component is polybutadiene diol. The chain extenders include, but are not limited to, diols, triols and amine extenders. Any suitable polyisocyanate may be used to form a polyurethane according to the present invention. The polyisocyanate is preferably selected from the group of diisocyanates including, but not limited to, 4,4'-diphenylmethane diisocyanate ("MDI"); 2,4-toluene diisocyanate ("TDI"); m-xylylene diisocyanate ("XDI"); methylene bis-(4-cyclohexyl isocyanate) ("HMDI"); hexamethylene diisocyanate ("HDI"); naphthalene-1,5,-diisocyanate ("NDI"); 3,3'-dimethyl-4,4'-biphenyl diisocyanate ("TODI"); 1,4-diisocyanate benzene ("PPDI"); phenylene-1,4-diisocyanate; and 2,2,4- or 2,4,4-trimethyl hexamethylene diisocyanate ("TMDI").

Other less preferred diisocyanates include, but are not limited to, isophorone diisocyanate ("IPDI"); 1,4-cyclohexyl diisocyanate ("CHDI"); diphenylether-4,4'-diisocyanate; p,p'-diphenyl diisocyanate; lysine diisocyanate ("LDI"); 1,3-bis (isocyanato methyl) cyclohexane; and polymethylene polyphenyl isocyanate ("PMDI").

One additional polyurethane component which can be used in the present invention incorporates TMXDI ("META") aliphatic isocyanate (Cytec Industries, West Paterson, N.J.). Polyurethanes based on meta-tetramethylxylylene diisocyanate (TMXDI) can provide improved gloss retention UV light stability, thermal stability, and hydrolytic stability. Additionally, TMXDI ("META") aliphatic isocyanate has demonstrated favorable toxicological properties. Furthermore, because it has a low viscosity, it is usable with a wider range of diols (to polyurethane) and diamines (to polyureas). If TMXDI is used, it typically, but not necessarily, is added as a direct replacement for some or all of the other aliphatic isocyanates in accordance with the suggestions of the supplier. Because of slow reactivity of TMXDI, it may be useful or necessary to use catalysts to have practical demolding times. Hardness, tensile strength and elongation can be adjusted by adding further materials in accordance with the supplier's instructions.

The cover layer 24 preferably comprises a polyurethane with a Shore D hardness (plaque) of from about 10 to about 55 (Shore C of about 15 to about 75), more preferably from about 25 to about 55 (Shore C of about 40 to about 75), and most preferably from about 30 to about 55 (Shore C of about 45 to about 75) for a soft cover layer 24 and from about 20 to about 90, preferably about 30 to about 80, and more preferably about 40 to about 70 for a hard cover layer 14.

The polyurethane preferably has a flex modulus from about 1 to about 310 Kpsi, more preferably from about 3 to about 100 Kpsi, and most preferably from about 3 to about 40 Kpsi for a soft cover layer 14 and 40 to 90 Kpsi for a hard cover layer 24.

Non-limiting examples of a polyurethane suitable for use in mantle layer 28 include a thermoplastic polyester polyurethane such as Bayer Corporation's TEXIN polyester polyurethane (such as TEXIN DP7-1097 and TEXIN 285 grades) and a polyester polyurethane such as B. F. Goodrich Company's ESTANE polyester polyurethane (such as ESTANE X-4517 grade). The thermoplastic polyurethane material may be blended with a soft ionomer or other non-ionomer. For example, polyamides blend well with soft ionomer.

Other soft, relatively low modulus non-ionomeric thermoplastic or thermoset polyurethanes may also be utilized, as long as the non-ionomeric materials produce the playability and durability characteristics desired without adversely affecting the enhanced travel distance characteristic produced by the high acid ionomer resin composition. These include, but are not limited to thermoplastic polyurethanes such as the PELLETHANE thermoplastic polyurethanes from Dow Chemical Co.; and non-ionomeric thermoset polyurethanes including but not limited to those disclosed in U.S. Pat. No. 5,334,673, which is hereby incorporated by reference.

Typically, there are two classes of thermoplastic polyurethane materials: aliphatic polyurethanes and aromatic polyurethanes. The aliphatic materials are produced from a polyol or polyols and aliphatic isocyanates, such as $H_{12}$MDI or HDI, and the aromatic materials are produced from a polyol or polyols and aromatic isocyanates, such as MDI or TDI. The thermoplastic polyurethanes may also be produced from a blend of both aliphatic and aromatic materials, such as a blend of HDI and TDI with a polyol or polyols.

Generally, the aliphatic thermoplastic polyurethanes are lightfast, meaning that they do not yellow appreciably upon exposure to ultraviolet light. Conversely, aromatic thermoplastic polyurethanes tend to yellow upon exposure to ultraviolet light. One method of stopping the yellowing of the aromatic materials is to paint the outer surface of the finished ball with a coating containing a pigment, such as titanium dioxide, so that the ultraviolet light is prevented from reaching the surface of the ball. Another method is to add UV absorbers, optical brighteners and stabilizers to the clear coating(s) on the outer cover, as well as to the thermoplastic polyurethane material itself. By adding UV absorbers and stabilizers to the thermoplastic polyurethane and the coating(s), aromatic polyurethanes can be effectively used in the outer cover layer of golf balls. This is advantageous because aromatic polyurethanes typically have better scuff resistance characteristics than aliphatic polyurethanes, and the aromatic polyarethanes typically cost less than the aliphatic polyurethanes.

Other suitable polyurethane materials for use in the present invention golf balls include reaction injection molded ("RIM") polyurethanes. RIME is a process by which highly reactive liquids are injected into a mold, mixed usually by impingement and/or mechanical mixing in an in-line device such as a "peanut mixer," where they polymerize primarily in the mold to form a coherent, one-piece molded article. The RIM process usually involves a rapid reaction between one or more reactive components such as a polyether polyol or polyester polyol, polyamine, or other material with an active hydrogen, and one or more isocyanate-containing constituents, often in the presence of a catalyst. The constituents are stored in separate tanks prior to molding and may be first mixed in a mix head upstream of a mold and then injected into the mold. The liquid streams are metered in the desired weight to weight ratio and fed into an impingement mix head, with mixing occurring under high pressure, for example, 1,500 to 3,000 psi. The liquid streams impinge upon each other in the mixing chamber of the mix head and the mixture is injected into the mold. One of the liquid streams typically contains a catalyst for the reaction. The constituents react rapidly after mixing to gel and form polyurethane polymers. Polyureas, epoxies, and various unsaturated polyesters also can be molded by RIM. Further descriptions of suitable RIM systems is disclosed in U.S. Pat. No. 6,663,508, which pertinent parts are hereby incorporated by reference.

Non-limiting examples of suitable RIM systems for use in the present invention are BAYFLEX elastomeric polyurethane RIM systems, BAYDUR GS solid polyurethane RIM systems, PRISM solid polyurethane RIM systems, all from Bayer Corp. (Pittsburgh, Pa.), SPECTRIM reaction moldable polyurethane and polyurea systems from Dow Chemical USA (Midland, Mich.), including SPECTRIM MM 373-A (isocyanate) and 373-B (polyol), and ELASTOLIT SR systems from BASF (Parsippany, N.J.). Preferred RIM systems include BAYFLEX MP-10000, BAYFLEX MP-7500 and BAYFLEX 110-50, filled and unfilled. Further preferred examples are polyols, polyamines and isocyanates formed by processes for recycling polyurethanes and polyureas. Additionally, these various systems may be modified by incorporating a butadiene component in the diol agent.

Another preferred embodiment is a golf ball in which at least one of the boundary layer 28 and/or the cover layer 24 comprises a fast-chemical-reaction-produced component. This component comprises at least one material selected from the group consisting of polyurethane, polyurea, polyurethane ionomer, epoxy, and unsaturated polyesters, and preferably comprises polyurethane, polyurea or a blend comprising polyurethanes and/or polymers. A particularly preferred form of the invention is a golf ball with a cover comprising polyurethane or a polyurethane blend.

The polyol component typically contains additives, such as stabilizers, flow modifiers, catalysts, combustion modifiers, blowing agents, fillers, pigments, optical brighteners, and release agents to modify physical characteristics of the cover. Polyurethane/polyurea constituent molecules that were derived from recycled polyurethane can be added in the polyol component.

Other materials available for use for the cover or boundary layer include highly neutralized or fully neutralized acid copolymers or terpolymers either alone or modified with other thermoplastic materials, fatty acids, and/or fatty acid salts. These materials may be further modified with metal oxides or metal hydroxides such as MgO or Mg(OH)2. These materials may yet further be modified with a high density filler such as BaSO4. Such materials are available from DuPont and sold under the HPF brand. Further, such materials are disclosed in co-pending U.S. patent application Ser. No. 10/905,925, filed on Jan. 28, 2005, and U.S. patent application Ser. No. 11/065,217, filed on Feb. 23, 2006, which are both hereby incorporated by reference in their entireties.

The surface geometry of the golf ball 20 is preferably a conventional dimple pattern such as disclosed in U.S. Pat. No. 6,213,898 for a Golf Ball With An Aerodynamic Surface On A Polyurethane Cover, which pertinent parts are hereby incorporated by reference. Alternatively, the surface geometry of the golf ball 20 may have a non-dimple pattern such as disclosed in U.S. Pat. No. 6,290,615 for A Golf Ball Having Tubular Lattice Pattern, which pertinent parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf ball comprising:

a core comprising a spherical shell having a shell wall defining an interior chamber, a plurality of internal structures partitioning the interior chamber of the spherical shell into a plurality of sub-chambers, wherein each of the plurality of sub-chambers is in flow communication with another sub-chamber, wherein each of the plurality of sub-chambers has a volume ranging from ten percent to fifty percent of the volume of the interior chamber, wherein the plurality of internal structures comprises from two to ten internal structures, and a fluid material within the spherical shell; and a cover.

2. The golf ball according to claim 1 wherein each of the plurality of internal structures has a thickness ranging from 0.010 inch to 0.250 inch.

3. The golf ball according to claim 1 wherein each of the plurality of internal structures has a thickness ranging from 0.035 inch to 0.150 inch.

4. The golf ball according to claim 1 wherein each of the plurality of internal structures has a thickness ranging from 0.050 inch to 0.100 inch.

5. The golf ball according to claim 1 wherein the fluid material is selected from the group consisting of corn syrup, alcohol, water, propylene, glycol and mineral oil.

6. The golf ball according to claim 1 wherein the fluid material is glycerine.

7. The golf ball according to claim 1 wherein the spherical shell is composed of a material selected from the group consisting of vinyl resins, polyolefins, polyurethanes, polyamides, acrylic resins, thermoplastic rubbers, polyphenylene oxides, thermoplastic polyesters, polycarbonates, and blends thereof.

* * * * *